US007060014B2

(12) United States Patent
Bergman et al.

(10) Patent No.: US 7,060,014 B2
(45) Date of Patent: Jun. 13, 2006

(54) DEVICE AND METHOD FOR PERFORMING PUSH-UP EXERCISES

(76) Inventors: Frank Bergman, 387 Stonybrook Dr., Levittown, PA (US) 19055; Shahriar Jahanian, Dept. of Mech. Eng. 2320 E. San Ramon Ave. M/S EE15, Fresno, CA (US) 93740

( * ) Notice: Subject to any disclaimer, the term of this patent is extended or adjusted under 35 U.S.C. 154(b) by 122 days.

(21) Appl. No.: 10/299,547

(22) Filed: Nov. 20, 2002

(65) Prior Publication Data

US 2004/0097352 A1 May 20, 2004

(51) Int. Cl.
*A63B 26/00* (2006.01)
*A63B 71/00* (2006.01)

(52) U.S. Cl. ..... 482/141; 482/142; 482/148

(58) Field of Classification Search ..... 482/141, 482/62, 148, 142; D21/676.686
See application file for complete search history.

(56) References Cited

U.S. PATENT DOCUMENTS 5,033,741 A 7/1991 Ganzer ..... 272/135
5,106,079 A * 4/1992 Escobedo et al. ..... 482/97
5,330,408 A * 7/1994 Westmoreland, Jr. ..... 482/141
6,110,078 A * 8/2000 Dyer ..... 482/79
2002/0193210 A1* 12/2002 Turner ..... 482/80

* cited by examiner

*Primary Examiner*—Gregory L. Huson
*Assistant Examiner*—L. Amerson
(74) *Attorney, Agent, or Firm*—LaMorte & Associates

(57) ABSTRACT

An exercise machine and associated method for assisting a person in performing a push-up. The exercise machine has a body support platform that extends from a point of rotation at a variable angle of inclination. A user lays prone on the body support platform to perform a push-up. When a person laying on the body support platform performs a push-up, the body support platform rotates around its point of rotation from a first angle of inclination to a second angle of inclination. A bias mechanism is used to bias the body support platform toward one angle of inclination. Depending upon the needs of the user, the bias mechanism can be configured to either apply an upward bias to the body support platform that would assist a person in performing a push-up, or apply a downward bias to the body support platform that would resist a person in performing a push-up.

10 Claims, 3 Drawing Sheets

DEVICE AND METHOD FOR PERFORMING PUSH-UP EXERCISES

BACKGROUND OF THE INVENTION

1. Field of the Invention

The present invention relates to exercise machines that either assist or resist the ability of a person to perform a push-up.

2. Prior Art Statement

In the endeavor of physical exercise, few exercises are performed more often than are push-ups. To perform a push-up, a person does not need any exercise equipment other than a firm floor. Yet, push-up exercises are very useful in developing and/or rehabilitating the muscles of the chest and arms.

Since push-ups do not require any exercise equipment, push-up exercises are often recommended to people who do not have any exercise equipment at home and require development of the arms and/or chest.

A push-up is an exercise where a person lays prone on a flat surface and pushes himself/herself away from the flat surface using his/her arms. However, push-ups cannot be performed by all people. Many people, due to injury, age or lack of physical ability, lack the upper body strength needed to do even one push-up. Such people often become discouraged from exercising since they cannot perform this simple exercise.

On the other end of the fitness spectrum are people who have such a large degree of upper body strength, that a push-up does not provide enough resistance to challenge that person's muscles. Such people are therefore required to go to a gym or purchase exercise equipment that can provide enough resistance to present a challenging workout.

In the prior art, there are many devices that have been invented that are intended to either help a person performing a push-up or resist a person performing a push-up. In this manner, people either too weak to benefit from push-ups or too strong to benefit from push-ups can use push-ups to exercise. Devices that assist a person in performing a push-up typically have handles on which the hands are placed when doing a push-up. A piston or other such device is then used to help move the handles toward one another and assist in the push-up. Such prior art devices are exemplified by U.S. Pat. No. 5,330,408 to Westmoreland, entitled Apparatus For Maximizing Push-ups.

Exercise devices that add resistance to doing a push-up, typically apply weight to the back of the person performing the push-up. In this manner, the person doing the push-up must lift their own torso weight plus whatever added weight is placed on the back. Such prior art exercise devices are exemplified by U.S. Pat. No. 5,033,741 to Ganzer, entitled Isometric Push-up Machine.

When performing a push-up, the back is held straight while the arms are used to push the weight of the torso away from the floor. Many people whose arm and chest muscles would benefit from push-ups lack muscle strength in their backs and legs to perform a traditional push-up. For example, people recovering from back surgery may lack the strength in their back muscles to hold their back straight during a push-up. Similarly, people who are paralyzed below the torso lack the ability to do a push-up since their legs cannot support their body weight while doing a push-up.

A need therefore exists for an exercise device that can assist a weak person in performing a push-up, resist a strong person from performing a push-up and enable people who are paralyzed or have weak lower body strength to perform push-ups. This need is met by the present invention as described and claimed below.

SUMMARY OF THE INVENTION

The present invention is an exercise machine and associated method for assisting a person in performing a push-up. The exercise machine has a body support platform that extends from a point of rotation at a variable angle of inclination. A user lays prone on the body support platform to perform a push-up, wherein the body support platform extends along a user's legs and torso. The presence of the body support platform under the user's body eliminates stresses on the legs and back that prevent many people from being able to perform a push-up.

When a person laying on the body support platform performs a push-up, the body support platform rotates around its point of rotation from a first angle of inclination to a second angle of inclination. The exercise device may also include a bias mechanism that biases the body support platform toward one angle of inclination. Depending upon the needs of the user, the bias mechanism can be configured to either apply an upward bias to the body support platform that would assist a person in performing a push-up, or apply a downward bias to the body support platform that would resist a person in performing a push-up.

BRIEF DESCRIPTION OF THE DRAWINGS

For a better understanding of the present invention, reference is made to the following description of exemplary embodiments therefore, considered in conjunction with the accompanying drawings, in which.

DETAILED DESCRIPTION OF THE DRAWINGS

Figure 1:
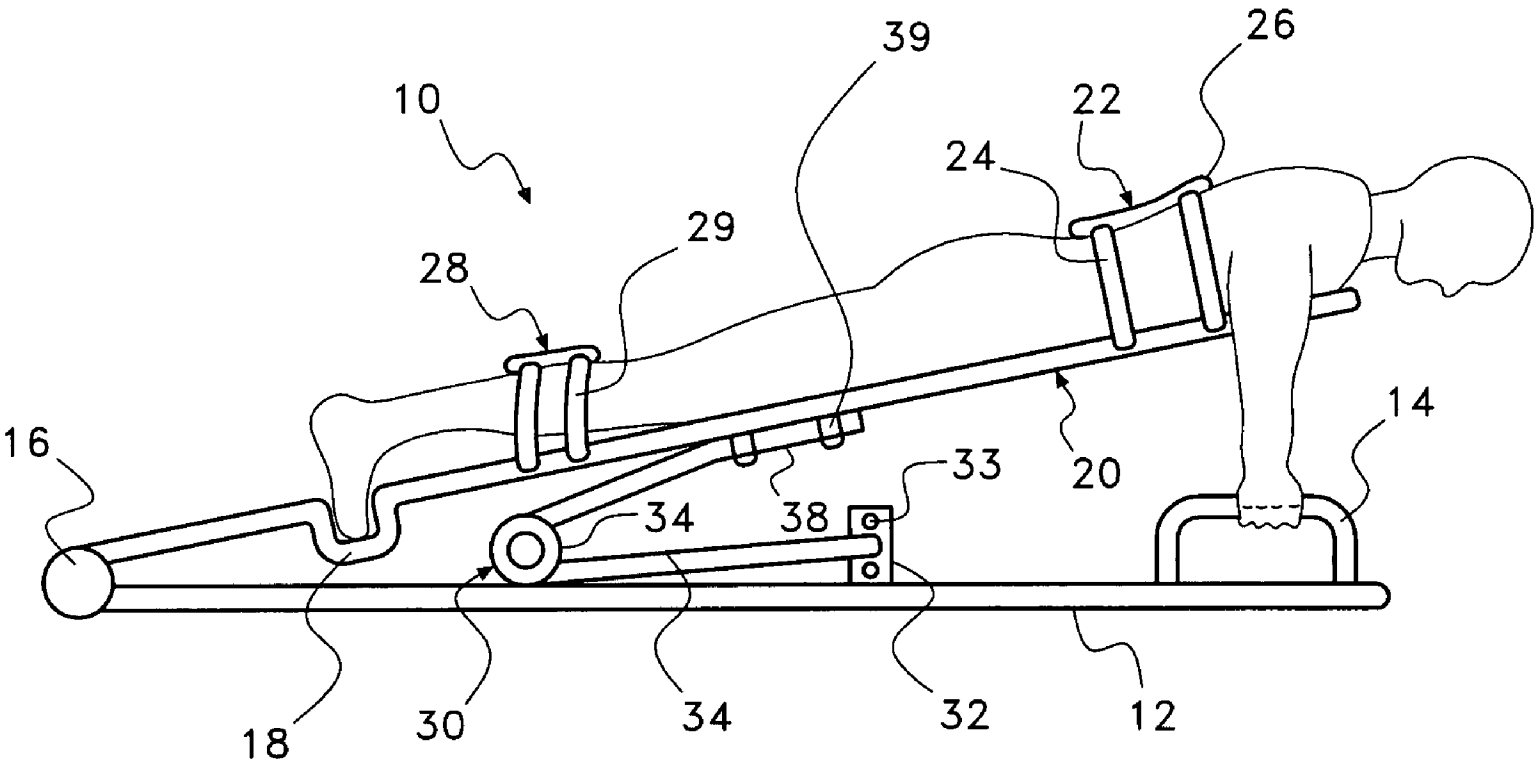
FIG. 1 is a side view of a first exemplary embodiment of the present invention exercise device, shown in conjunction with a user performing a push-up.

Referring to FIG. 1, a first exemplary embodiment of the present invention exercise device 10 is shown. In this embodiment there is a support base 12 that rests on the floor. A pair of handles 14 extends upwardly from the support base 12. The handles 14 are grasped by the hands when a person is doing a push-up. The handles 14 can be selectively attached to the support base 12 so that the handles 14 can be ergonomically positioned to match the physical requirements of different sized people.

A body support platform 20 is attached to the support base 12 at a hinged connection 16. The hinged connection 16 is connected to one end of the body support platform 20. Consequently, the body support platform 20 can rotate about the hinged connection 16. The body support platform 20 extends above the support base 12 at an adjustable angle of inclination.

The body support platform 20 has a length of between 3.5 feet and six feet. The width of the body support platform 20 is between four inches and twenty four inches. Since the top surface of the body support platform 20 contacts a user's body, it can be cushioned along its length.

A foot depression 18 is formed in the body support platform 20 near the hinged connection 16. The foot depression 18 receives the feet of the person laying on the body support platform 20. Accordingly, by allowing the user's feet to pass into the foot depression 18, the user's legs can lay flush against the body support platform 20.

A torso restraint system 22 is provided that biases the torso of a user against the body support platform 20. The torso restraint system 22 consists of at least one strap 24 that is mechanically attached to the body support platform 20 and passes around the torso of the user. A back pad 26 can be provided to prevent the straps 24 from causing discomfort on a user's back as the straps 24 are tightened around the user's back.

An optional leg restraint system 28 can also be used. The leg restraint system 28 consists of at least one strap 29 that attaches the legs of the user to the body support platform 20. The leg restraint system 28 is reserved for persons who have paralyzed, or otherwise infirm legs and are unable to control the position of their legs.

A person performs a push-up by lying flat on the body support platform 20. In this position, a person's feet should pass into the foot depression 18 and the body support platform 20 should extend along their body and terminate at a point between the sternum and neck. Once on the body support platform 20, the torso restraint system 22 is tightened so that the user's torso is attached to the body support platform 20 and cannot be lifted away from the body support platform 20.

Once in position on the body support platform 20, a person's arms are free to hang below the body support platform 20. As such, a person can grip the handles 14 that are located on the support base 12. Once the handles 14 are grasped, a person is free to conduct push-ups. As a person does a push-up, the body support platform 20 moves with the user's body from a first angle of inclination to a second angle of inclination and back again. The body support platform 20 supports the length of the user's body and prevents the legs or back from receiving any significant stress. Furthermore, by using the torso restraint system 22, the body support platform 20 remains in contact with the user's body through both the up stroke and down stroke of the push-up.

It will therefore be understood that by using the present invention exercise device 10, paralyzed people, people recovering from back injury, and others with weak backs or legs can perform push-ups.

In addition to providing body support, the present invention exercise device 10 can also help or hinder a person while performing a push-up utilizing an adjustable bias assembly 30. In the embodiment of FIG. 1, at least one stop structure 32 extends upwardly from the support base 12. Each stop structure 32 has a predetermined height that is engineered so that the body support platform 20 contacts each stop structure 32 at a predetermined angle of inclination. Accordingly, the presence of the stop structures 32 prevents the body support platform 20 from descending too low and contacting the base support platform 12.

At least one torsion spring 34 is provided. Each torsion spring 34 has a first arm 36 that engages a stop structure 32 and a second arm 38 that engages the bottom of the body support platform 20. The first arm 36 of the torsion spring 34 engages a stop structure 32. Different holes 33 are formed in each stop structure 32 along the length of that stop structure 32. The first arm 36 of the torsion spring 34 has a hooked end that passes into one of the holes 33. The second arm 38 of the torsion spring 34 mechanically engages the bottom of the body support structure 20 by passing through retaining hoops 39 or some other structure that can engage and retain the second arm 38.

If the torsion spring 34 biases its two arms toward a large angle of above thirty degrees, the torsion spring 34 will act to bias the body support platform 20 away from the support base 12 as a person conducts a push-up. Depending upon the number of torsion springs 34 used and the spring constant of the torsion springs 30, a selected upward bias can be applied to the body support platform 20. The upward bias applied by the torsion springs 34 helps a person perform a push-up by opposing the weight of that person. The upward bias applied by the torsion springs 34 can be anywhere from five pounds to three-hundred pounds, depending upon the needs of the user.

To make large changes in the upward bias applied by the torsion springs 34, the number of torsion springs 34 and the strength of the torsion springs 34 used, can be selectively changed. To make small changes in the upward bias applied by the torsion springs 34, the point of connection between the first arm 36 of each torsion spring 34 and the stop structure 32 can be selectively altered. By connecting the first arm 36 of a torsion spring 34 to a higher hole 33 in the stop structure 32, the effective strength of the torsion spring 34 can be increased. Similarly, by connecting the first arm 36 of a torsion spring 34 to a lower hole 33, the effective strength of that torsion spring 34 can be decreased.

Accordingly, a person weighing 200 pounds may require an upward force of 150 pounds to do a normal push-up. Utilizing the present invention exercise device 10, that required push-up force can be selectively decreased to any selected weight from zero pounds up to 150 pounds.

However, each torsion spring 34 used in the exercise device 10 may bias its two arms 36, 38 toward a small angle of less than ten degrees. With such a torsion spring 34 it takes force to open the arms 36, 38 of the torsion spring 34 beyond ten degrees. If such a small angle torsion spring 34 were applied to the exercise device 10, the torsion spring 34 would bias the body support platform 20 toward the support base 12 and would resist a person trying to perform a push-up. As a person presses upwardly while performing a push-up, that person's body remains in abutment with the body support platform 20 due to the restraint system 22. Accordingly, a person requiring only 150 pounds of force to do a normal push-up, may be required to apply 200 pounds of force to complete a push-up using the exercise device 10. Again, the degree of resistance provided by the torsion springs 34 is determined by the number of torsion springs 34 used, the strength of the torsion springs 34 and the points of connection utilized for the torsion springs 34.

Figure 2:
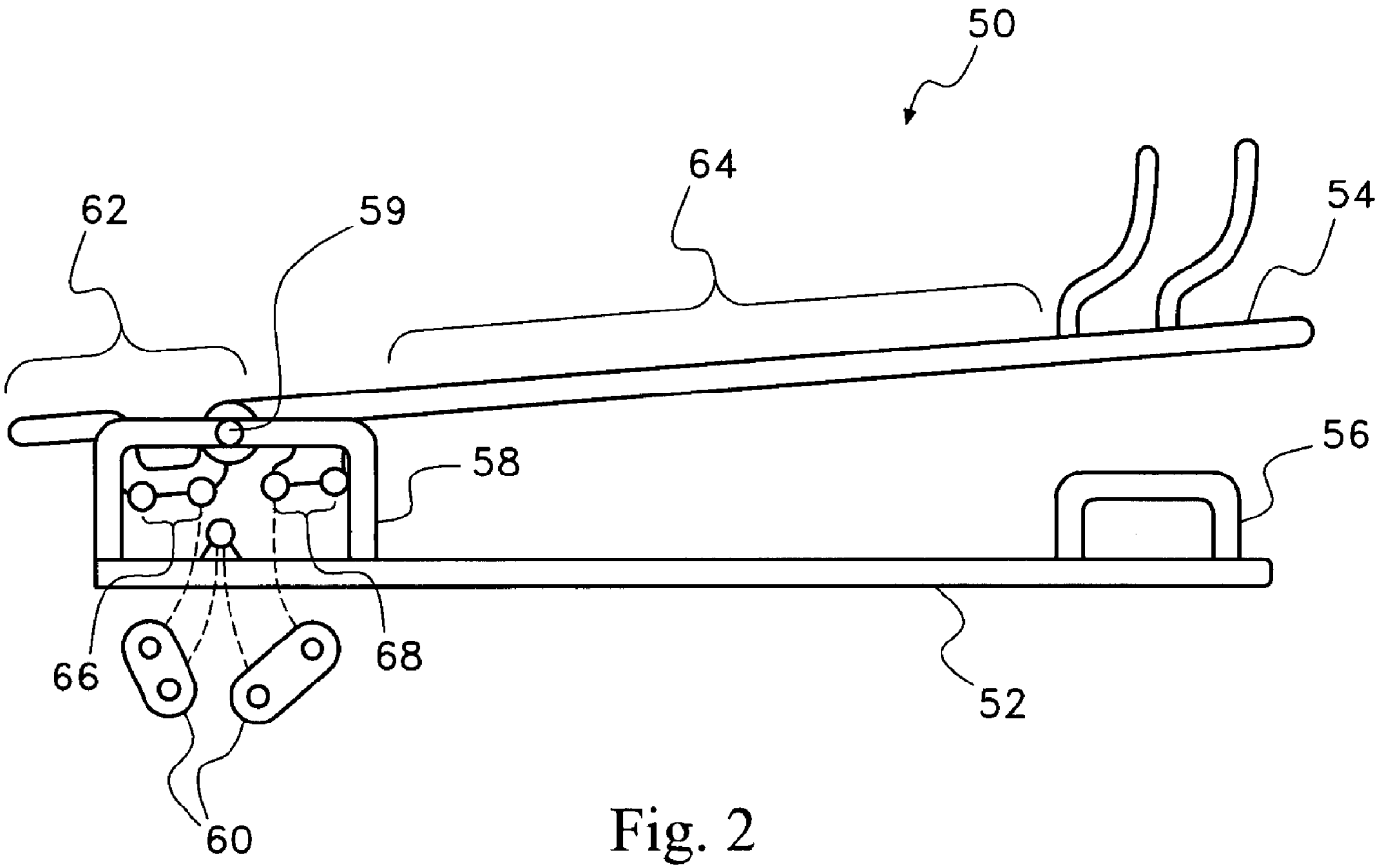
FIG. 2 is a side view of a second exemplary embodiment of the present invention exercise device.

Referring now to FIG. 2, an alternate embodiment of the present invention exercise device 50 is shown. In this embodiment, both a support base 52 and a body support platform 54 are provided. Handles 56 extend upwardly from the support base 52. Brackets 58 also extend upwardly from opposite sides of the support base 52. The body support platform 54 is interconnected with the support base 52 by a pivot axle 59 that extends between the brackets 58, thereby creating a hinged connection. The body support platform 54 overlaps the hinged connection. Accordingly, a rear section 62 of the body support platform 54 extends behind the hinged connection and a front section 64 of the body support platform 54 extends in front of the hinged connection.

In the embodiment of FIG. 2, variably sized elastomeric bands 60 are used to provide resistance or assistance, depending upon their installed orientation. A first set of band connector posts 66 are present under the rear section 62 of the body support platform 54 behind the hinged connection. A second set of band connector posts 68 is disposed under the front section 64 of the body support platform 54, in front of the hinged connection. Lastly, a third set of band connector posts 70 are disposed on the support base 52 below the hinged connection.

When elastomeric bands 60 are attached between the first set of band connector posts 66 and the third set of band connector posts 70, the rear section 62 of the body support platform 54 is biased downwardly. The hinged connection acts as a fulcrum and the front section 64 of the body support platform 54 is biased upwardly. Accordingly, the presence of the elastomeric bands 60, in the described application, assists a person in conducting a push-up.

By attaching elastomeric bands 60 between the second set of band connector posts 68 and the third set of band connector posts 70, the elastomeric bands 60 now apply a downward bias to the front section 64 of the body support platform 54. This downward bias increases the force needed to perform a push-up, thereby making a push-up more difficult to perform.

It will be understood that the number and strength of the various elastomeric bands 60 can be selectively altered. Accordingly, the forces applied by the elastomeric bands 60 in either assisting a push-up or resisting a push-up can be selectively adjusted by the user of the exercise device 50.

Figure 3:
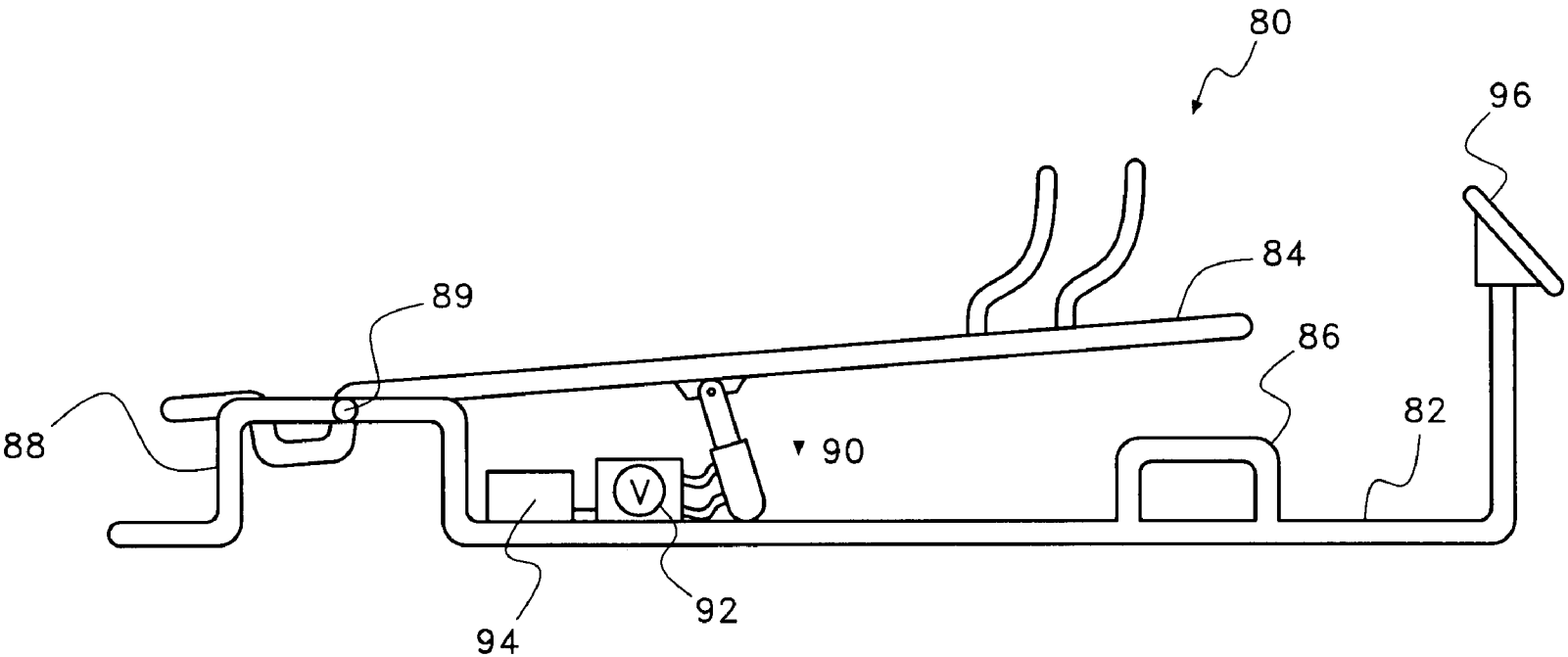
FIG. 3 is a side view of a third exemplary embodiment of the present invention exercise device.

Referring now to FIG. 3, a third exemplary embodiment of the present invention exercise device 80 is shown. In this embodiment, again, there is a support base 82 and a body support platform 84. Handles 86 extend upwardly from the support base 82. Brackets 88 also extend upwardly from opposite sides of the support base 82. The body support platform 84 is interconnected with the support base 82 by a pivot axle 89 that extends between the brackets 88, thereby creating a hinged connection.

At least one piston 90 is disposed under the body support platform 84. The two ends of the piston 90 are connected to the body support platform 84 and the support base 82, respectively. As the piston 90 expands, the piston 90 biases the body support platform 84 upwardly. As the piston 90 retracts, the piston 90 biases the body support platform 84 downwardly. The force applied by the piston 90 in moving the body support platform 84 either upwardly or downwardly depends upon the diameter of the piston 90 and the pneumatic or hydraulic pressure received by the piston 90.

The flow of pneumatic or hydraulic pressure into the piston 90 is controlled by electronically controlled valves 92 and a systems controller 94 that controls the operation of the valves 92. The systems controller 94 and the valves 92 combine to regulate the flow of pressure into and out of the piston 90. The systems controller 94 can be connected to a user interface 96 that enables a user to preprogram what forces of push-up resistance or push-up assistance are required. The systems controller 94 reads the data entered through the user interface 96 and controls the valves 92 accordingly so that the piston 90 applies the forces selected.

In the three embodiments of the present invention described, there exists a support base, a body support platform and a bias mechanism that can either assist in or resist performing a push-up. In all embodiments, the resistance or assistance provided by the bias mechanism is selectively adjustable. Accordingly, a user can select the degree of assistance or resistance desired.

It will be understood that the specifics of the embodiments illustrated and described are merely exemplary and that other embodiments of the present invention can be created. For example, there are many electrical and/or mechanical assemblies that can be placed between the support base and the body support platform that can be used to selectively apply an upward bias and/or a downward bias to the body support platform. It will therefore be understood that a person skilled in the art can therefore make numerous alterations and modifications to the shown embodiments utilizing functionally equivalent components to those shown and described. All such modifications are intended to be included within the scope of the present invention as defined by the claims.

What is claimed is:

1. An exercise device for push-ups, comprising:

a support base;

a body support platform for supporting a user's legs and torso, said body support platform being coupled to said support base, wherein said body support platform is selectively positionable throughout a range from a low first angle of inclination and a higher second angle of inclination relative said support base;

at least one restraint element attached to said body support, wherein said at least one restraint element holds said body support platform in abutment with the user's torso, and an adjustable biasing mechanism that can be set to selectively bias said body support platform toward either said low first angle of inclination or said higher second angle of inclination with a predetermined biasing force, thereby enabling said adjustable biasing mechanism to either assist or resists a push-up exercise.

2. The device according to claim 1, further including an adjustment mechanism for selectively adjusting said predetermined force applied by said biasing mechanism.

3. The device according to claim 1, further including a set of handles extending upwardly from said support base, wherein said body support platform is supported above and between said handles.

4. The device according to claim 1, wherein said biasing mechanism utilizes at least one biasing element for creating said predetermined biasing force, wherein said at least one biasing element is selected from a group consisting of springs, pistons and elastomeric bands.

5. The device according to claim 1, wherein said body support platform is joined to said support base at a hinged connection and said body support platform rotates about said hinged connection throughout said range between said low first angle of inclination and said higher second angle of inclination.

6. An exercise device for push-ups, comprising:

a support base;

a body support platform coupled to said support base, said body support platform being sized to support a user's legs and torso during a push-up exercise, wherein said body support platform is selectively positionable throughout a range from a first angle of inclination to a second angle of inclination relative said support base; and a bias mechanism for applying a biasing force to said body support platform, wherein said bias mechanism can be selectively adjusted to apply said biasing forth to assist with a push-up or resist a push-up.

7. The device according to claim 6, further including at least one restraint element attached to said body support platform for holding a user's torso in abutment with said body support platform.

8. The device according to claim 6, further including a set of handles extending upwardly from said support base, wherein said body support platform is supported above and between said handles.

9. The device according to claim 6, wherein said biasing mechanism has at least one biasing element that is selected from a group consisting of springs, pistons and elastomeric bands.

10. The device according to claim 6, wherein said body support platform is joined to said support base at a hinged connection and said body support platform rotates about said hinged connection throughout said range from said first angle of inclination and said second angle of inclination.

* * * * *